US012305635B2

(12) United States Patent
Wang et al.

(10) Patent No.: US 12,305,635 B2
(45) Date of Patent: May 20, 2025

(54) COMPRESSOR FOR HEAT EXCHANGE SYSTEM, HEAT EXCHANGE SYSTEM AND METHOD FOR CONTROLLING OPERATION OF COMPRESSOR

(71) Applicant: Carrier Corporation, Palm Beach Gardens, FL (US)

(72) Inventors: Jin Wang, Shanghai (CN); LiFeng Wang, Shanghai (CN); Huaxiong Wei, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 332 days.

(21) Appl. No.: 17/122,091

(22) Filed: Dec. 15, 2020

(65) Prior Publication Data

US 2021/0285707 A1 Sep. 16, 2021

(30) Foreign Application Priority Data

Mar. 10, 2020 (CN) ..... 202010162126.4

(51) Int. Cl.

| | |
|---|---|
| ***F04B 49/24*** | (2006.01) |
| ***F04B 7/02*** | (2006.01) |
| ***F04B 35/04*** | (2006.01) |
| ***F04B 49/22*** | (2006.01) |
| ***F04C 28/12*** | (2006.01) |

(52) U.S. Cl.

CPC ..... *F04B 49/24* (2013.01); *F04B 35/04* (2013.01); *F04B 49/22* (2013.01); *F04C 28/125* (2013.01); *F04B 7/02* (2013.01); *F04B 49/225* (2013.01); *F04B 2203/0201* (2013.01); *F04B 2203/0207* (2013.01)

(58) Field of Classification Search

CPC ..... H02P 25/20; F04B 35/04; F04B 49/02; F04B 49/22; F04B 49/225; F04B 49/24; F04C 28/12; F04C 28/125; F04C 28/24; F04C 28/26; F04C 28/08

USPC ..... 417/295, 441; 318/704, 773

See application file for complete search history.

(56) References Cited

U.S. PATENT DOCUMENTS 3,527,548 A * 9/1970 Grant ..... F04C 28/26 417/310

4,336,001 A * 6/1982 Andrew ..... F25B 49/022 417/310

(Continued)

*Primary Examiner* — Philip E Stimpert

(74) *Attorney, Agent, or Firm* — CANTOR COLBURN LLP

(57) ABSTRACT

The disclosure relates to compressors for heat exchange systems, heat exchange systems having such compressors, and methods for controlling operation of compressors. The compressor includes a drive device for driving the compressor and having at least a first and second working conditions. An output power of the drive device under the second working condition is greater than an output power under the first working condition. The compressor has at least one upload/download flow path configured to be opened before the drive device is switched from the first working condition to the second working condition to reduce a suction flow of the compressor until current operating parameters of the compressor reach preset values, after which the switching is performed, and to increase the suction flow until the compressor is in a required working state, after the switching is completed.

21 Claims, 4 Drawing Sheets

(56) References Cited

U.S. PATENT DOCUMENTS

| | | | | |
|---|---|---|---|---|
| 4,382,749 | A * | 5/1983 | Teegarden | F04B 49/02 417/415 |
| 4,523,431 | A * | 6/1985 | Budzich | F15B 11/055 60/431 |
| 4,831,313 | A * | 5/1989 | Beilfuss | F25B 49/025 388/933 |
| 2010/0202904 | A1 * | 8/2010 | Pileski | F04C 18/16 417/310 |

* cited by examiner

COMPRESSOR FOR HEAT EXCHANGE SYSTEM, HEAT EXCHANGE SYSTEM AND METHOD FOR CONTROLLING OPERATION OF COMPRESSOR

CROSS-REFERENCE TO RELATED APPLICATIONS

This application claims priority to Chinese Patent Application No. 202010162126.4, filed Mar. 10, 2020, the contents of which are incorporated by reference herein in their entirety.

BACKGROUND

The present disclosure relates to the technical field of heat exchange, and in particular to a compressor for a heat exchange system, a heat exchange system including the compressor, and a method for controlling operation of a compressor.

A dual speed motor has been configured in some existing compressors such as screw compressors to enable the compressors to operate under different working conditions as required so as to improve performance indicators such as integrated part load value (IPLV). This type of dual speed motor was originally invented by the Swedish engineer Robert Dahlander. It usually uses special windings and changes the number of poles by changing the external connection mode of the motor, thereby providing two working speeds, i.e., a high speed and a low speed.

However, it has been found that in some applications, for example, when the dual speed motor is switched from the low speed to the high speed to promote the compressor to have a larger suction flow, the torque required for the compressor to operate at this point may exceed the maximum torque that the dual speed motor itself can provide (a part of the area in the curve A1 as shown in FIG. 1), which causes the compressor to stop operating, thereby affecting the normal operation of the entire system. Taking many reasons such as the complexity of the design and use of the dual speed motor itself, and the safety and reliability of the compressor and the overall system into consideration, it has always been customary in the industry to directly substitute a dual speed motor with a higher working capacity to meet application requirements.

SUMMARY

In view of the foregoing, the present disclosure provides a compressor for a heat exchange system, a heat exchange system including the compressor, and a method for controlling operation of a compressor, so as to solve or at least alleviate one or more of the problems described above as well as problems of other aspects existing in the prior art.

Firstly, according to an aspect of the present disclosure, a compressor for a heat exchange system is provided, which comprises a drive device for driving the compressor and having at least a first working condition and a second working condition, an output power of the drive device under the second working condition being greater than the output power of the drive device under the first working condition, and the compressor has at least one upload/download flow path, which is configured to be opened before the drive device is switched from the first working condition to the second working condition, to reduce a suction flow of the compressor until current operating parameters of the compressor reach preset values, after which the switching is performed, and to increase the suction flow until the compressor is in a required working state, after the switching is completed.

In the compressor for the heat exchange system according to the present disclosure, optionally, the upload/download flow path comprises one or more bypass flow paths arranged in parallel with a flow path for adjusting the suction flow in the compressor, and a control valve is disposed in the bypass flow path and is configured to be opened before the drive device is switched from the first working condition to the second working condition, to allow a fluid to be compressed in the compressor to flow through the bypass flow path.

In the compressor for the heat exchange system according to the present disclosure, optionally, the flow path for adjusting the suction flow comprises a compressor slide valve, a first pipeline communicating with a slide valve cavity and a suction cavity of the compressor, a second pipeline communicating with the slide valve cavity and a lubricant supply port of the compressor, a first valve disposed in the first pipeline, and a second valve disposed in the second pipeline.

In the compressor for the heat exchange system according to the present disclosure, optionally, the first valve, the second valve and/or the control valve are solenoid valves.

In the compressor for the heat exchange system according to the present disclosure, optionally, the upload/download flow path comprises a plunger valve disposed on a rotor side of the compressor and configured to be opened before the drive device is switched from the first working condition to the second working condition.

In the compressor for the heat exchange system according to the present disclosure, optionally, the compressor is provided with a controller connected to the upload/download flow path and configured to control the fluid flow of at least one of the upload/download flow paths.

In the compressor for the heat exchange system according to the present disclosure, optionally, the compressor is provided with a flow path for adjusting the suction flow, and the controller is further configured to control the fluid flow in the flow path for adjusting the suction flow before the drive device is switched from the first working condition to the second working condition.

In the compressor for the heat exchange system according to the present disclosure, optionally, a compressor slide valve is disposed in the flow path for adjusting the suction flow, and the controller is configured to control an opening degree of the compressor slide valve.

In the compressor for the heat exchange system according to the present disclosure, optionally, the compressor is a screw compressor or a piston compressor, the drive device is a dual speed motor, and/or the operating parameters are operating current, operating torque and/or operating duration.

In the compressor for the heat exchange system according to the present disclosure, optionally, the preset value of the operating current is not greater than the current value corresponding to the torque required by the drive device to complete the switching from the first working condition to the second working condition.

Secondly, according to a second aspect of the present disclosure, a heat exchange system is also provided, which comprises the compressor for the heat exchange system as described in any one of the above.

In addition, according to a third aspect of the present disclosure, a method for controlling operation of a compressor is also provided. The method includes operating the drive device for driving the compressor for the heat exchange system as described in any one of the above under the first working condition, opening the upload/download flow path of the compressor before the drive device needs to be switched from the first working condition to the second working condition, to reduce the suction flow of the compressor, monitoring whether the current operating parameters of the compressor have reached preset values, and performing the switching if the current operating parameters have reached the preset values, and after the switching is completed, increasing the suction flow of the compressor by controlling the upload/download flow path until the compressor is in a required working state.

From the following detailed description combined with the accompanying drawings, the principles, features, characteristics and advantages of the technical solutions according to the present disclosure will be clearly understood. For example, as compared with the prior art, the present disclosure is easy to install, use and maintain, has a low cost, and can be applied very conveniently and flexibly, thereby effectively ensuring that the process of switching the compressor's working condition is safe, reliable and efficient, which helps to improve product competitiveness The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The technical solutions of the present disclosure will be described in further detail below with reference to the accompanying drawings and embodiments. However, it should be understood that these drawings are designed merely for the purpose of explanation and only intended to conceptually illustrate the structural configurations described herein and are not required to be drawn to scale.

DETAILED DESCRIPTION

Figure 1:
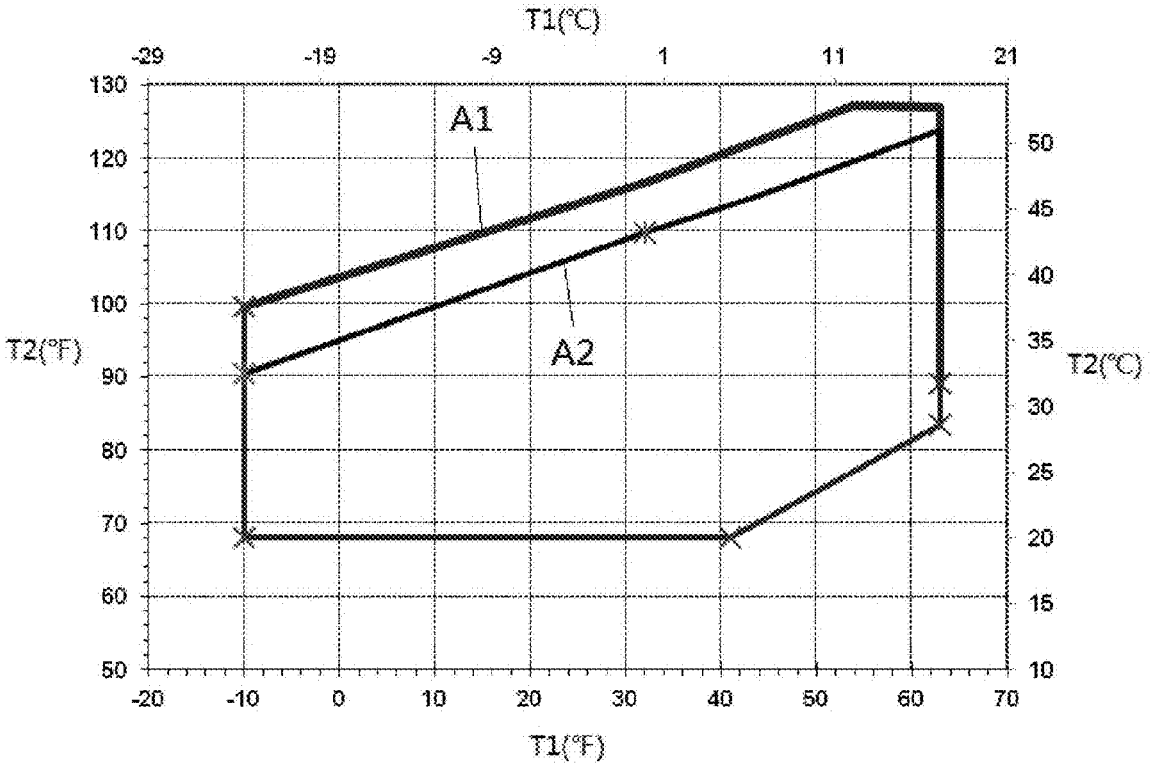
FIG. 1 is a schematic diagram of a compressor operating range of a compressor with a dual speed motor when a R-134a refrigerant is used, wherein the horizontal coordinate T1 represents a saturated suction temperature, and the vertical coordinate T2 represents a saturated discharge temperature; curve A1 is a complete compressor operating range, and curve A2 is a reduced compressor operating range; in some areas of curve A1, the compressor cannot be switched from a low speed to a high speed, while in the entire area of curve A2, the compressor can be freely switched between the high speed and the low speed.

As shown and described herein, various features of the disclosure will be presented. Various embodiments may have the same or similar features and thus the same or similar features may be labeled with the same reference numeral, but preceded by a different first number indicating the figure to which the feature is shown. Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Firstly, it should be noted that the structure, components, steps, characteristics, advantages and the like of the compressor for a heat exchange system, the heat exchange system including the compressor, and the method for controlling operation of a compressor according to the present disclosure will be described below by way of example. However, it should be understood that all the descriptions should not be understood as limiting the present disclosure in any way. Herein, the technical terms "first" and "second" are merely used for distinguishing purpose, and are not intended to indicate their order and relative importance. The technical term "connect (or connected, etc.)" covers a situation where a specific component is directly connected to another component and/or indirectly connected to another component.

In addition, for any single technical feature described or implied in the embodiments mentioned herein, the present disclosure still allows for any combination or deletion of these technical features (or equivalents thereof), thereby obtaining more other embodiments of the present disclosure that may not be directly mentioned herein. In addition, for the sake of simplifying the drawings, identical or similar elements and features may be marked in only one or more places in the same drawing.

Figure 2:
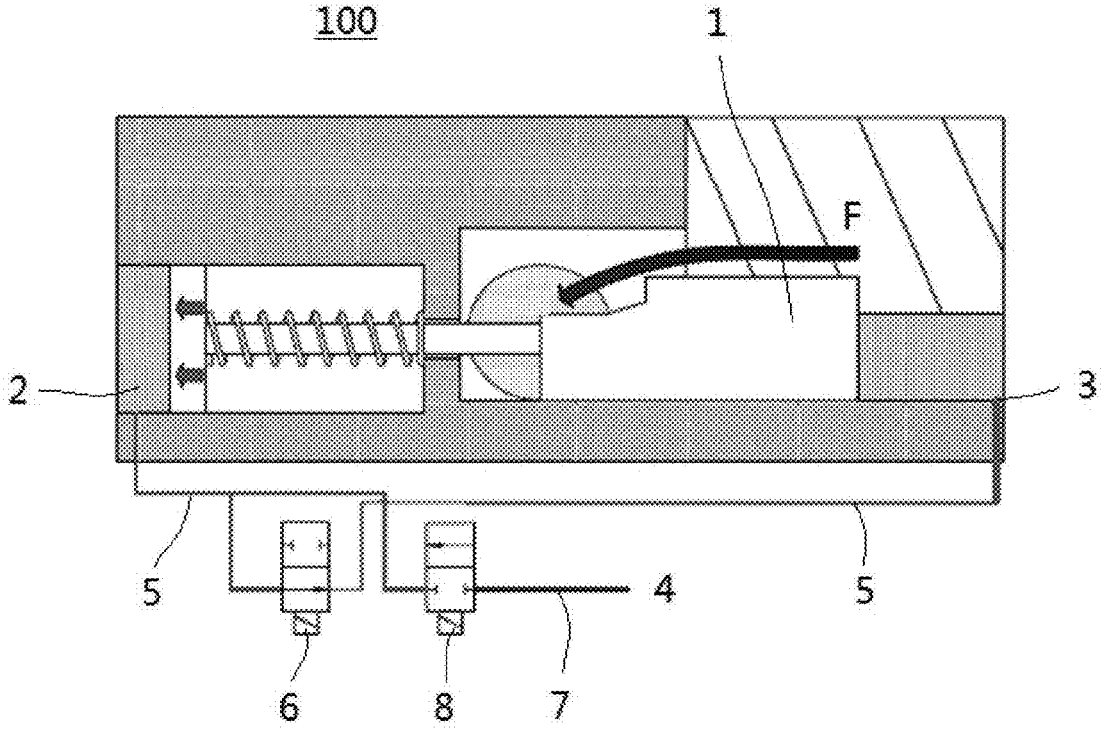
FIG. 2 is a schematic diagram of an embodiment of a compressor for a heat exchange system according to the present disclosure, in which only a flow path for adjusting a suction flow in the compressor is shown and the flow path can be used to perform upload and downloading operations during working condition switching.
Figure 3:
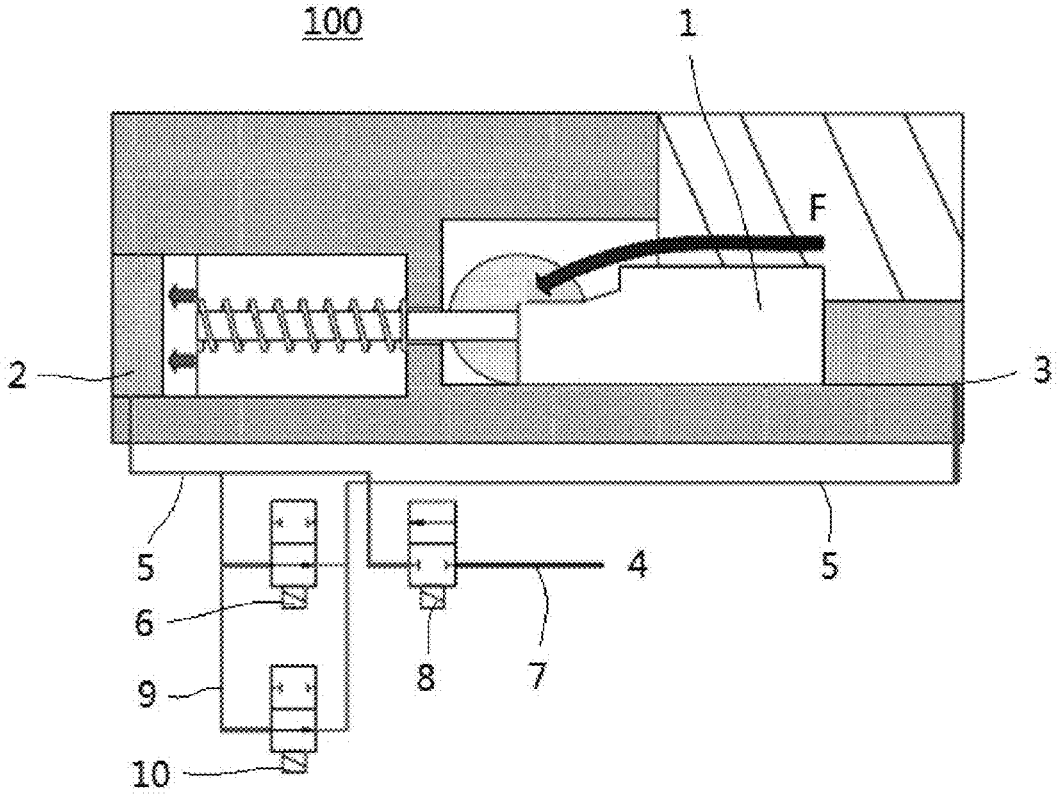
FIG. 3 is another schematic diagram of the embodiment of the compressor shown in FIG. 2, in which a bypass flow path and the flow path for adjusting the suction flow in the compressor are shown at the same time, and their states before the working condition switching are shown.
Figure 4:
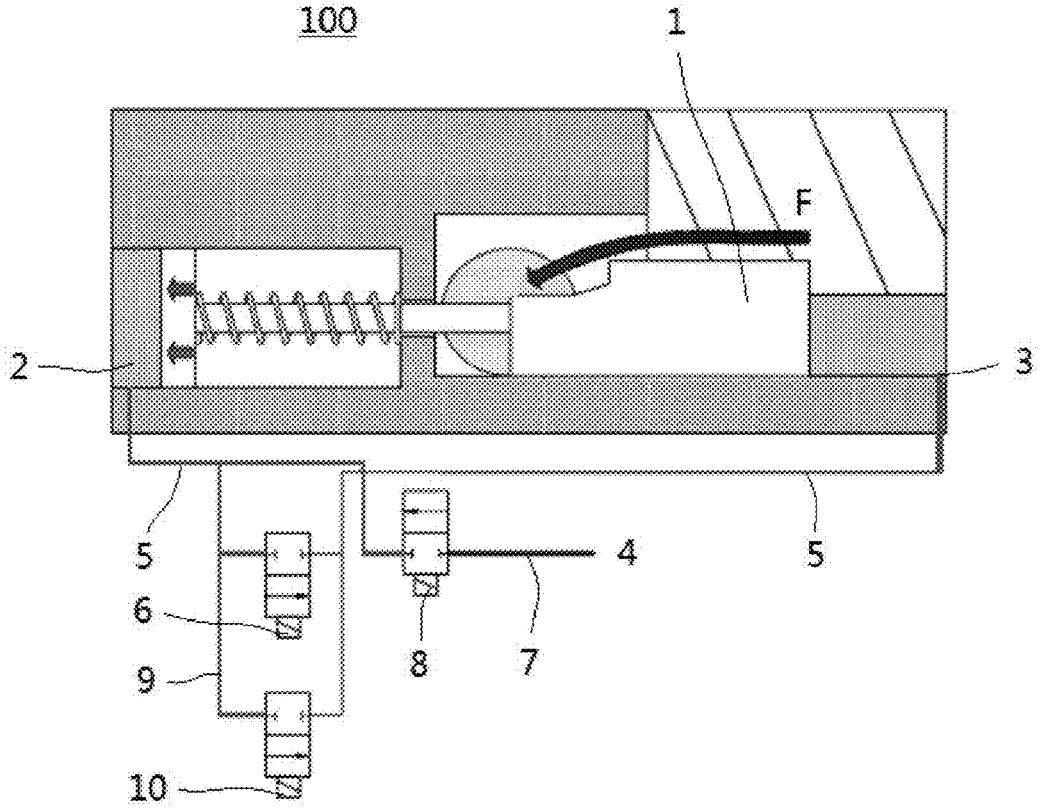
FIG. 4 is further another schematic diagram of the embodiment of the compressor shown in FIG. 2, in which the bypass flow path and the flow path for adjusting the suction flow in the compressor are shown at the same time, and their states when not used for the working condition switching are shown.

First, FIGS. 2 to 4 only schematically show an embodiment of the compressor for a heat exchange system according to the present disclosure. For the sake of clarity, not all the constituent elements of the compressor are drawn in these drawings, and general items that have been known to those skilled in the art will not be repeated herein.

Reference is made to FIG. 2, FIG. 3 and FIG. 4 in combination, in the example given, the compressor 100 has a drive device for supplying power to it. Such a drive device may be any suitable device such as an electric motor or a fuel-powered device, and it can provide two or more different working conditions, such that the drive device can operate at two, three or more different speeds to realize these different working conditions. For example, a dual speed motor may be configured for the compressor 100, and the dual speed motor may have two different working speeds (that is, corresponding to a first working condition with a relatively low output power, and a relatively high second working condition). For example, one of the working speeds is the maximum speed (that is, full speed), and the other is half of the maximum speed (that is, half speed), so that two output powers can be selectively provided for the compressor to better meet the requirements on the compressor in different applications.

In general, according to the design idea of the present disclosure, the compressor 100 may be provided with an upload/download flow path, so that before the above-mentioned drive device is switched from the first working condition among these working conditions to another relatively high second working condition, the fluid flow path can be opened by opening the upload/download flow path to perform the unloading operation (also called the downloading operation), which can reduce the flow (i.e., the suction flow) of the fluid (which is typically gaseous, and may also be in a form of gas-liquid mixture) currently suctioned in the compressor 100, reduce the current load of the compressor 100, and thereby reduce the power required by the compressor 100 during the working condition switching without exceeding the configured maximum capacity of the drive device (such as a dual speed motor, etc.). Therefore, the aforementioned shortcomings and deficiencies in the existing compressors can be effectively overcome. In particular, the present disclosure completely obviates the traditional way of directly substituting a motor to provide a higher power output, which has been quite common for a long term in the industry, whereas providing a higher power output is just obvious to solving the above problem, and has long been taken for granted by those skilled in the art.

In addition, after the above-mentioned working condition switching is completed, the suction flow of the compressor can be increased (that is, the uploading operation) through the upload/download flow path in the compressor 100, so as to promote the compressor 100 to enter a required working state.

For the above-mentioned upload/download flow path, whether the working condition switching can be performed can be judged by monitoring whether current operating parameters of the compressor (such as operating current, operating torque and/or operating duration, which can be selected individually or in any combination as required, and can be monitored using any feasible method such as various corresponding techniques known in the art) have reached preset values. For example, when the monitored operating current is lower than a preset value thereof (or it is also allowed to consider that the monitored operating duration has reached a preset value thereof), the working condition can be switched. Then, the compressor can be uploaded to the actual required working state through the upload/download flow path.

It should be noted that the present disclosure allows the aforementioned preset values to be set and adjusted freely according to actual needs. For example, for the preset current value, it may be for example set to be less than or greater than a certain current value obtained based on analysis and calculation, engineering test data or empirical value setting, etc. (for example, it may be a current value corresponding to the torque required for the drive device of the compressor to complete the switching between two working conditions) in some embodiments, thereby fully ensuring the flexibility of various applications.

As shown in FIG. 2, the compressor 100 may have a flow path for adjusting the suction flow. In some applications, such flow path may be used as the above-mentioned upload/download flow path in the present disclosure.

Figure 5:
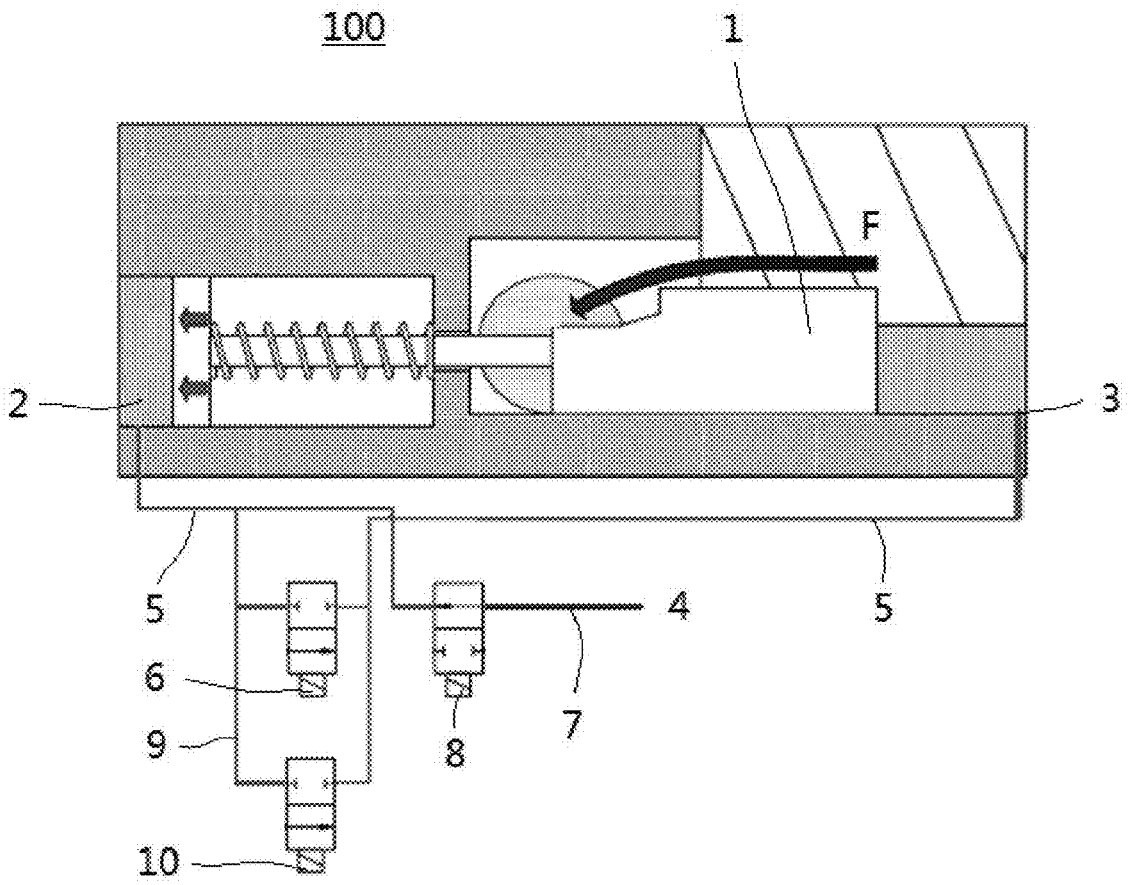
FIG. 5 is still further another schematic diagram of the embodiment of the compressor shown in FIG. 2, in which the bypass flow path and the flow path for adjusting the suction flow in the compressor are shown at the same time, and their states during the uploading operation are shown.

Specifically, as an example and for the sake of convenience, only one of the above-mentioned flow paths is shown separately in FIG. 2, which may include a compressor slide valve 1, a pipeline 5, a valve 6, a pipeline 7, and a valve 8. The valve 6 and the valve 8 may be arranged in the pipeline 5 and the pipeline 7 respectively, and when the valve 6 is opened, the pipeline 5 is used to connect a slide valve cavity 2 and a suction cavity 3 of the compressor 100, thereby providing a path for a part of the fluid that has been currently suctioned to flow back to the suction cavity, so as to realize the unloading function of the flow path, which is schematically shown in FIGS. 2 and 3; in addition, when the valve 8 is opened, the pipeline 7 can also be used to connect the slide valve cavity 2 and a lubricant supply port 4, so that components such as a piston in the compressor 100 can be pushed to perform corresponding movements by supplying a compressor lubricant (such as lubricating oil, etc.) from the lubricant supply port 4 toward the slide valve cavity 2 when needed, thereby prompting the compressor 100 to increase the suction flow at this point to realize the uploading function of the flow path, which is schematically shown in FIG. 5.

For the valve 6 and the valve 8, each of them may be any suitable component such as a solenoid valve, so as to correspondingly control on-off of the flow path, the fluid flow and the like of the above-mentioned pipelines 5 and 7 respectively according to the needs of upload and downloading operations. For example, in the situation of unloading operation shown in FIGS. 2 and 3, the valve 6 may be opened to provide an unload flow path, and the valve 8 may be in a closed state; for another example, in the situation of uploading operation shown in FIG. 5, the valve 8 may be opened to provide an upload flow path, and the valve 6 and the control valve 10 that will be described later are both in a closed state; for further another example, FIG. 4 shows that the valves 6, 8 and the control valve 10 are all in a closed state, that is, the upload/download flow path is in a closed state, which corresponds to a situation in which the flow path is not used for working condition switching.

With continued reference to FIGS. 2 and 3 for comparison, a bypass flow path in the compressor and the flow path for adjusting the suction flow shown in FIG. 2 are shown in FIG. 3 at the same time. A bypass flow path 9 may also be optionally provided in the compressor 100 to further play the role of the upload/download flow path discussed above, that is, the bypass flow path 9 can realize the functions of the above-mentioned unloading operation and/or uploading operation. For example, as shown in FIG. 3, the bypass flow path 9 may be arranged in parallel with the flow path for adjusting the suction flow in FIG. 2 discussed above. For example, it may be arranged in parallel with the pipeline 5 so as to further increase the flow of unloaded fluid and make the unloading process more rapid and efficient, thereby helping to complete the switching of working conditions safely, reliably and quickly. Also, the bypass flow path 9 is allowed to be optionally arranged in parallel with the pipeline 7, which can enhance the effect of the uploading operation.

As an exemplary comparison description, as compared with the arrangement shown in FIG. 2, the arrangement shown in FIG. 3 not only can control the duration of the entire working condition switching process more flexibly and effectively, and reduce or avoid a possible decrease in the sensitivity of the compressor caused by a longer duration, which would make the compressor product lose competitiveness, but also enables the cost of used parts to be lowered, and also makes installation, use, and maintenance operations very convenient.

In addition, it should be noted that the number of the above discussed bypass flow path 9 provided in the compressor may for example be one, two or more according to specific application requirements.

Further, a control valve 10 (such as a solenoid valve, etc.) may be arranged in the bypass flow path 9, so as to control the bypass flow path 9 to be opened as required. For example, the control valve 10 is shown in an open state in FIG. 3, so that the fluid in the compressor can flow through the bypass flow path 9; then, after the selected operating parameters of the compressor reach preset values (such as when the operating current drops to the preset value), the bypass flow path 9 is closed. In addition, in the above process, the fluid flow in the bypass flow path 9 can be optionally and flexibly controlled through the control valve 10; for example, a working state or mode in which the fluid unloading degree, the torque required by the compressor, and the working condition switching duration are all relatively moderate can be achieved as required.

In addition, as an optional situation, the upload/download flow path may also be implemented in any suitable other form. For example, in some embodiments, a plunger valve (not shown) may be provided on a rotor side of the compressor, so that before the drive device is switched from the first working condition to the second working condition, the plunger valve can be opened to reduce the load currently required by the compressor as discussed above, and the switching of working conditions can be completed after the selected operating parameters of the compressor reach preset values (such as when the operating current of the compressor drops to the preset value). Therefore, the plunger valve can be closed or the actual opening degree of the plunger valve can be controlled according to specific needs.

It should be noted that the above exemplarily given upload/download flow paths according to the present disclosure, such as the bypass flow path connected in parallel, the plunger valve, etc., may be provided separately, or may be combined with other forms of upload/download flow paths for use in combination, so that the influences of factors such as device volume, installation site, cost, performance effect and the like can be fully considered, and quite flexible practical applications can be achieved.

By way of example only, for example, when the plunger valve discussed above and the upload/download flow path shown in FIG. 2 are installed and configured at the same time, the user can select one of the following working states or modes by himself/herself through a flexibly configuration. A first working state or mode, in which the plunger valve is in the open position, and the compressor slide valve in the compressor is in a fully open position; at this point, the compressor has the largest unloading degree, the minimum torque required, and the shortest working condition switching duration. A second working state or mode, in which the plunger valve is in the open position, and the compressor slide valve is in the closed position; at this point, the compressor has the smallest unloading degree, a larger torque required, and a longer working condition switching duration, but can still realize the switching of working conditions. A third working state or mode, in which the plunger valve is in the open position, and the compressor slide valve is in a certain intermediate open position; at this point, the compressor has a moderate unloading degree, a moderate torque required, and a moderate working condition switching duration as well. A fourth working state or mode, in which the plunger valve is in the closed position, and the compressor slide valve is in the closed position; this will be the state when the compressor is not in working condition switching.

Figure 6:
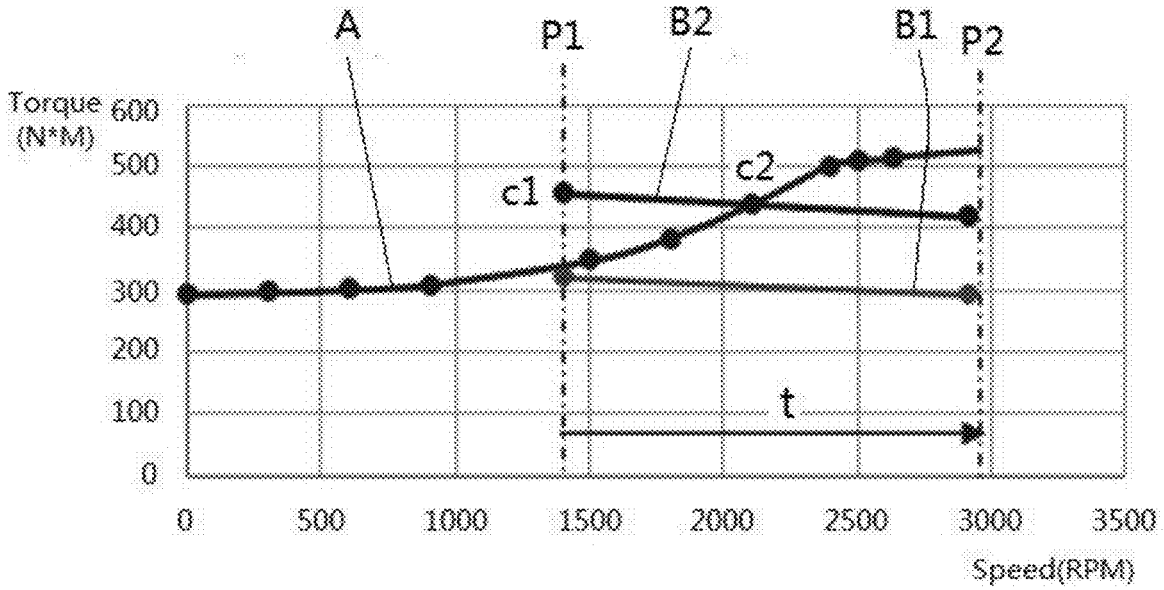
FIG. 6 is a schematic diagram showing a comparison between compressor operating torques when an upload/download flow path is used for the unload/downloading operation and when the upload/download flow path is not used for the unload/downloading operation, in a case where an embodiment of the compressor for the heat exchange system according to the present disclosure is used for switching between two working conditions.

FIG. 6 schematically shows a comparison of the unloading operation of an embodiment of the compressor according to the present disclosure with and without using the upload/download flow path before the switching of two working conditions. In FIG. 6, curve A shows the torque provided by the dual speed motor used to provide power when the rotational speed per minute (RPM) is from 0 to 3500, curve B1 shows the torque required by the embodiment of the compressor according to the present disclosure for the unloading operation using the upload/download flow path before the dual speed motor takes time t to switch from a lower working condition P1 (half speed at this point, i.e., 1500 RPM) to a higher working condition P2 (full speed at this point, i.e., 3000 RPM), and curve B2 shows the torque required by the embodiment of the compressor for the unloading operation without using the upload/download flow path before the same switching of working conditions. That is, curve B2 can be understood as the corresponding torque demand of the existing compressor in contrast to this embodiment of the compressor.

FIG. 6 clearly shows that the embodiment of the compressor according to the present disclosure can fully adapt to the configured dual speed motor by performing the fluid unloading operation, and will not cause the problem of shutdown due to insufficient current drive power during the working condition switching. On the contrary, if the corresponding fluid unloading operation is not performed, then the torque required for the working condition switching (that is, the corresponding interval between points c1 and c2 in FIG. 6) will be significantly higher than the torque that the dual speed motor can provide at this point, an undesirable compressor shutdown phenomenon will therefore occur, and this will bring many adverse influences as described above.

It can be understood that for the upload/download flow path and its components (such as the valve members, etc.) in the present disclosure, operations such as opening, closing, and adjusting the flow can be implemented manually or automatically. In an optional situation, a controller (not shown) may be provided in the compressor to realize part or all of the control operations in the upload/download flow path according to specific needs. For example, such a controller can be used to regulate the opening degree of the compressor slide valve, etc. The above-mentioned controller can not only be implemented separately through hardware (such as a suitable module, chip or processor, etc.), software or a combination thereof, but also can be incorporated into the control portion of the compressor itself, or even be used with other devices, apparatuses or systems (such as a heat exchange system in which the compressor is included) associated with the compressor.

According to another technical solution of the present disclosure, a heat exchange system is also provided, and the compressor for the heat exchange system provided by the present disclosure can be disposed in the heat exchange system. This type of heat exchange system can be used in different environments, and may have many types, such as heating, ventilation and air conditioning (HVAC) systems. It should also be noted that the "compressor" herein may include, but is not limited to, many types of compressors such as screw compressors and piston compressors.

Figure 7:
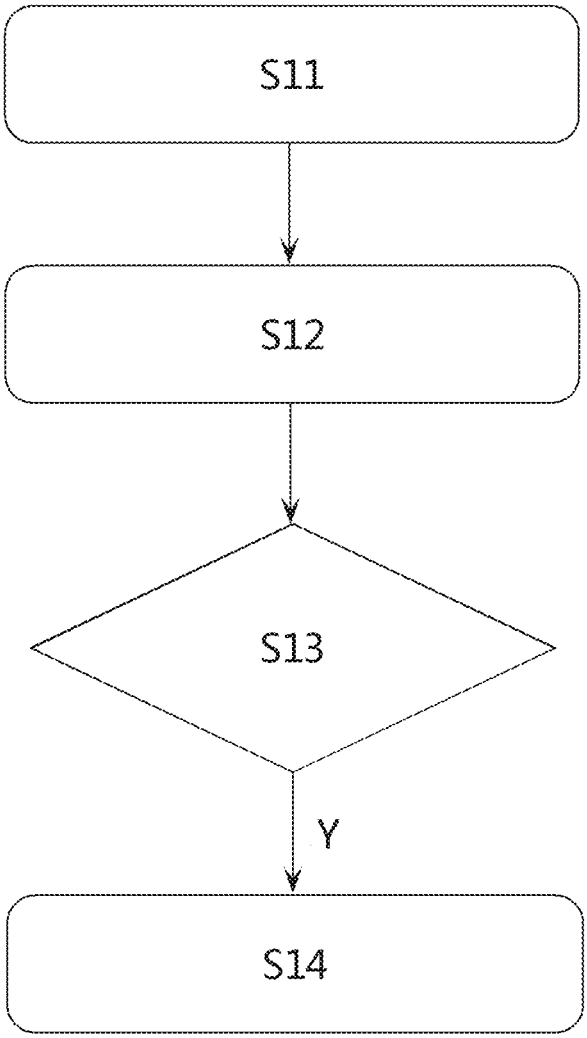
FIG. 7 is a schematic flowchart of an embodiment of a method for controlling operation of a compressor according to the present disclosure.

In addition, the present disclosure also provides a method for controlling operation of a compressor. As an exemplary illustration, as shown in FIG. 7, an example of the method for controlling operation of a compressor may include the following steps:

In step S11, the compressor for the heat exchange system according to the present disclosure is provided, and the drive device (such as a dual speed motor, etc.) therein is operated in the first working condition (such as in a half-speed mode, etc.) to provided power to the compressor.

Then, before it is required to switch the drive device from the first working condition to the second working condition (such as in a full-speed mode, etc.), in step S12, the upload/download flow path configured for the compressor can be opened to perform the unloading operation, which can reduce the suction flow of the compressor and reduce the power (such as torque) required by the compressor at this point.

Next, in step S13, whether the operating parameters (such as the operating current, the operating torque, the operating duration, etc.) of the compressor have reached preset values may be monitored according to actual needs by any feasible way such as monitoring whether the operating current has dropped to a preset value. If the preset value is reached, then the working condition can be switched. At this point, this part of the flow path used for the unloading operation can be optionally reduced to a certain flow (which is set according to the specific demand) and maintained, or any other suitable operations may be performed such as closing all the above flow paths.

In step S14, after the above working condition switching is completed, the above-mentioned upload/download flow path can be controlled to increase the suction flow of the compressor, and this operation can be repeated until the compressor is uploaded to a required working state. The above control operation may be implemented in many ways. For example, the valve 8 exemplarily discussed above can be opened to perform the uploading operation through the pipeline 7, and the valve 6 and/or the valve 10 can be controlled to gradually close the previous unload flow path so as to promote a gradual increase of the suction flow of the compressor.

In this way, by adopting the above steps according to the method example of the present disclosure, the operation switching process of the compressor can be effectively controlled and successfully completed.

It can be understood that since the technical contents such as the upload/download flow path of the compressor, the switching between different working conditions of the drive device, the unloading/uploading operations, the downloading operation, the operating parameters and their preset values, the heat exchange system and the like have been described previously in great detail, reference may be directly made to the specific descriptions of the corresponding parts in the above, so a repeated description will be omitted herein.

The compressor for a heat exchange system, the heat exchange system including the compressor, and the method for controlling operation of a compressor according to the present disclosure have been elaborated above in detail by way of example only. These examples are merely used to illustrate the principles and embodiments of the present disclosure, rather than limiting the present disclosure. Various modifications and improvements can be made by those skilled in the art without departing from the spirit and scope of the present disclosure. Therefore, all equivalent technical solutions should fall within the scope of the present disclosure and be defined by the claims of the present disclosure.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A compressor for a heat exchange system, comprising:

a drive device for driving the compressor and having at least a first working condition and a second working condition, an output power of the drive device under the second working condition being greater than the output power of the drive device under the first working condition, wherein the compressor has at least one upload/download flow path, which is configured to be opened before the drive device is switched from the first working condition to the second working condition, to reduce a suction flow of the compressor until current operating parameters of the compressor reach preset values, after the compressor reaches the preset values, the upload/download flow path is controlled to increase the suction flow until the compressor is in a required working state in the second working condition;

wherein the at least one upload/download flow path comprises a slide valve cavity housing a compressor slide valve, a first pipeline communicating with the slide valve cavity and a suction cavity of the compressor, and a first valve disposed in the first pipeline, the first valve configured to be opened to allow fluid through the at least one upload/download flow path or closed to block fluid through the at least one upload/download flow path, wherein the at least one upload/download flow path directly fluidly connects the slide valve cavity with the suction cavity of the compressor.

2. The compressor for the heat exchange system according to claim 1, wherein:

the upload/download flow path comprises one or more bypass flow paths arranged in parallel with a flow path for adjusting the suction flow in the compressor, and a control valve is disposed in the bypass flow path and is configured to be opened before the drive device is switched from the first working condition to the second working condition, to allow a fluid to be compressed in the compressor to flow through the bypass flow path providing a path for a part of the fluid that has been suctioned to flow back to the suction cavity.

3. The compressor for the heat exchange system according to claim 2, wherein:

a second pipeline communicating with the slide valve cavity and a lubricant supply port of the compressor, and a second valve disposed in the second pipeline.

4. The compressor for the heat exchange system according to claim 3, wherein at least one of the first valve, the second valve, and the control valve are solenoid valves.

5. The compressor for the heat exchange system according to claim 1, wherein the upload/download flow path comprises a plunger valve disposed on a rotor side of the compressor and configured to be opened before the drive device is switched from the first working condition to the second working condition.

6. The compressor for the heat exchange system according to claim 1, wherein the compressor is provided with a controller connected to the upload/download flow path and configured to control the fluid flow of at least one of the upload/download flow paths.

7. The compressor for the heat exchange system according to claim 6, wherein the compressor is provided with a flow path for adjusting the suction flow, and the controller is further configured to control the fluid flow in the flow path for adjusting the suction flow before the drive device is switched from the first working condition to the second working condition.

8. The compressor for the heat exchange system according to claim 7, wherein a compressor slide valve is disposed in the flow path for adjusting the suction flow, and the controller is configured to control an opening degree of the compressor slide valve.

9. The compressor for the heat exchange system according to claim 1, wherein the compressor is a screw compressor or a piston compressor.

10. The compressor for the heat exchange system according to claim 1, wherein the drive device is a dual speed motor.

11. The compressor for the heat exchange system according to claim 1, wherein the operating parameters are at least one of operating current, operating torque, and operating duration.

12. The compressor for the heat exchange system according to claim 11, wherein a preset value of the operating current is not greater than a current value corresponding to a torque required by the drive device to complete switching from the first working condition to the second working condition.

13. The compressor for the heat exchange system according to claim 1, wherein the drive device for driving the compressor operates continuously when transitioning between the first working condition and the second working condition.

14. A heat exchange system, comprising:

a compressor having:

a drive device for driving the compressor and having at least a first working condition and a second working condition, an output power of the drive device under the second working condition being greater than the output power of the drive device under the first working condition, wherein the compressor has at least one upload/download flow path, which is configured to be opened before the drive device is switched from the first working condition to the second working condition, to reduce a suction flow of the compressor until current operating parameters of the compressor reach preset values, after the compressor reaches the preset values, the upload/download flow path is controlled to increase the suction flow until the compressor is in a required working state in the second working condition;

wherein the at least one upload/download flow path comprises a slide valve cavity housing a compressor slide valve, a first pipeline communicating with the slide valve cavity and a suction cavity of the compressor, and a first valve disposed in the first pipeline, the first valve configured to be opened to allow fluid through the at least one upload/download flow path or closed to block fluid through the at least one upload/download flow path, wherein the at least one upload/download flow path directly fluidly connects the slide valve cavity with the suction cavity of the compressor.

15. The heat exchange system according to claim 14, wherein:

the upload/download flow path comprises one or more bypass flow paths arranged in parallel with a flow path for adjusting the suction flow in the compressor, and a control valve is disposed in the bypass flow path and is configured to be opened before the drive device is switched from the first working condition to the second working condition, to allow a fluid to be compressed in the compressor to flow through the bypass flow path.

16. The heat exchange system according to claim 14, wherein the upload/download flow path comprises a plunger valve disposed on a rotor side of the compressor and configured to be opened before the drive device is switched from the first working condition to the second working condition.

17. The heat exchange system according to claim 14, wherein the compressor is provided with a controller connected to the upload/download flow path and configured to control the fluid flow of at least one of the upload/download flow paths.

18. The heat exchange system according to claim 14, wherein the compressor is a screw compressor or a piston compressor.

19. The heat exchange system according to claim 14, wherein the drive device is a dual speed motor.

20. The heat exchange system according to claim 14, wherein the operating parameters are at least one of operating current, operating torque, and operating duration.

21. A method for controlling operation of a compressor, the compressor having a drive device for driving the compressor and having at least a first working condition and a second working condition, an output power of the drive device under the second working condition being greater than the output power of the drive device under the first working condition, wherein the compressor has at least one upload/download flow path, which is configured to be opened before the drive device is switched from the first working condition to the second working condition, to reduce a suction flow of the compressor until current operating parameters of the compressor reach preset values, after the compressor reaches the preset values, the upload/download flow path is controlled to increase the suction flow until the compressor is in a required working state in the second working condition, the method comprising:

operating the drive device for driving the compressor for the heat exchange system under the first working condition;

opening the upload/download flow path of the compressor before the drive device needs to be switched from the first working condition to the second working condition, to reduce the suction flow of the compressor;

monitoring whether the current operating parameters of the compressor have reached preset values; and after the compressor reaches the preset values, increasing the suction flow of the compressor by controlling the upload/download flow path until the compressor is in a required working state in the second working condition;

wherein the at least one upload/download flow path comprises a slide valve cavity housing a compressor slide valve, a first pipeline communicating with the slide valve cavity and a suction cavity of the compressor, and a first valve disposed in the first pipeline, the first valve configured to be opened to allow fluid through the at least one upload/download flow path or closed to block fluid through the at least one upload/download flow path, wherein the at least one upload/download flow path directly fluidly connects the slide valve cavity with the suction cavity of the compressor.

* * * * *